United States Patent [19]

Armstrong

[11] Patent Number: 4,520,895

[45] Date of Patent: Jun. 4, 1985

[54] BUILDING WALL DESCENT DEVICE HAVING MANUALLY OPERATED BRAKE MEANS

[76] Inventor: James A. Armstrong, 4911 Calvert, Cincinnati, Ohio 45209

[21] Appl. No.: 534,307

[22] Filed: Sep. 21, 1983

[51] Int. Cl.[3] ..... A62B 35/00

[52] U.S. Cl. ..... 182/3; 182/9

[58] Field of Search ..... 182/3, 5–7, 182/82, 240, 71, 193, 9; 188/65.1

[56] References Cited

U.S. PATENT DOCUMENTS

| | | | |
|---|---|---|---|
| Re. 28,273 | 12/1974 | Brda | 182/6 |
| 275,608 | 4/1883 | Drake | 182/240 |
| 446,001 | 2/1891 | Muller . | |
| 465,464 | 12/1891 | Dixon . | |
| 586,173 | 7/1897 | Frahm . | |
| 1,033,311 | 7/1912 | Gilloon et al. . | |
| 1,087,440 | 2/1914 | Freed . | |
| 2,437,864 | 3/1948 | Staley | 227/30 |
| 2,647,675 | 8/1953 | Bernett | 182/82 |
| 2,933,157 | 4/1960 | Huber | 188/65.1 |
| 3,403,750 | 10/1968 | Pomagalski | 182/189 |
| 3,467,224 | 9/1969 | Curtis et al. | 188/65.1 |
| 3,498,408 | 3/1970 | Foote | 182/6 |
| 3,861,497 | 1/1975 | Tsai | 182/5 |
| 3,880,255 | 4/1975 | Huntley | 182/5 |
| 3,944,021 | 3/1976 | Smith, Jr. et al. | 182/3 |
| 4,024,927 | 5/1977 | Sheppard | 182/5 |
| 4,197,816 | 5/1980 | Lusch | 119/96 |
| 4,406,349 | 9/1983 | Vilchek | 182/82 |

OTHER PUBLICATIONS

"Demonstration Goes Awry", *The Cincinnati Enquirer,* Friday, Nov. 4, 1982.

*Primary Examiner*—Reinaldo P. Machado
*Attorney, Agent, or Firm*—Frost & Jacobs

[57] ABSTRACT

A hand operated safety device for controlling the descent of a person along a guide track affixed to the exterior face of a building wall. The descent device is clamped to the track and includes a hydraulically operated brake which can be actuated to vary the frictional force between the descent device and the track surface to control the speed of descent. The device includes a preset mechanism for applying a fixed clamping force to the track depending on the user's weight. In a second embodiment, the track is a rail of triangular cross section having a continuous rack which is engaged by a brake operated spur gear on the descent device. A user wearable harness is slung beneath the descent device for lowering the person to the ground.

30 Claims, 5 Drawing Figures

BUILDING WALL DESCENT DEVICE HAVING MANUALLY OPERATED BRAKE MEANS

SUMMARY OF THE INVENTION

The present invention is directed to a hand operated device for lowering a person along the exterior face of a building wall, and finds particular utility for escape from a building under emergency conditions.

There have been many types of devices proposed for lowering a person to the ground along an exterior face of a building wall. One of the problems with such devices is controlling the speed of descent. If the user descends too quickly, he may be injured by contact against the building wall, or the ground. Controlling the speed of descent is even more critical under emergency escape conditions, where the user may be inexperienced or partially incapacitated, and under emotional stress.

The present invention is directed to a descent device where the speed of descent is under complete manual control of the user. In a prefered embodiment, the invention contemplates a vertically extending rail-like support track which is fixedly secured to the exterior building wall face. The track includes an outwardly extending flange running the length thereof and an outwardly extending web portion terminating at its outermost edge in a vertically extending flange-like head. The track can also be of generally triangular cross-section.

Hand operable brake means slidingly cooperates with the track for descending therealong at a selectable rate. Such means includes clamp means in the form of a pair of opposing jaws which slidingly engage the track and clamp the track flange therebetween with a predetermined force. The clamping jaws are actuated by manually graspable handles which move the jaws to a closed clamping position wherein the jaws are in abutting contact with the track with sufficient force to allow the jaws to slide along the track with some resistance. When the handles are moved apart, the jaws are opened and moved out of abutting contact with the track. The jaws and actuating handles used in the descent device of the present invention comprise a mechanical construction similar to that of locking pliers, as will be explained in more detail hereinafter.

A brake pad or shoe is also associated with one of the jaws, and is operable by a separately hand-held actuator handle connected to the brake means by a flexible cable or conduit. The brake pad or shoe, which may be hydraulically or mechanically operated, increase the clamping force against the track, thus controlling the sliding friction and the rate of descent along the track.

A harness is connected to the descent device which can be worn by the user so that the user hangs beneath the descent device. Thus, the user may control the rate of downward descent by selectively operating the brake controller.

Further details of the invention will become apparent from the detailed description which follows.

DETAILED DESCRIPTION

Figure 1:
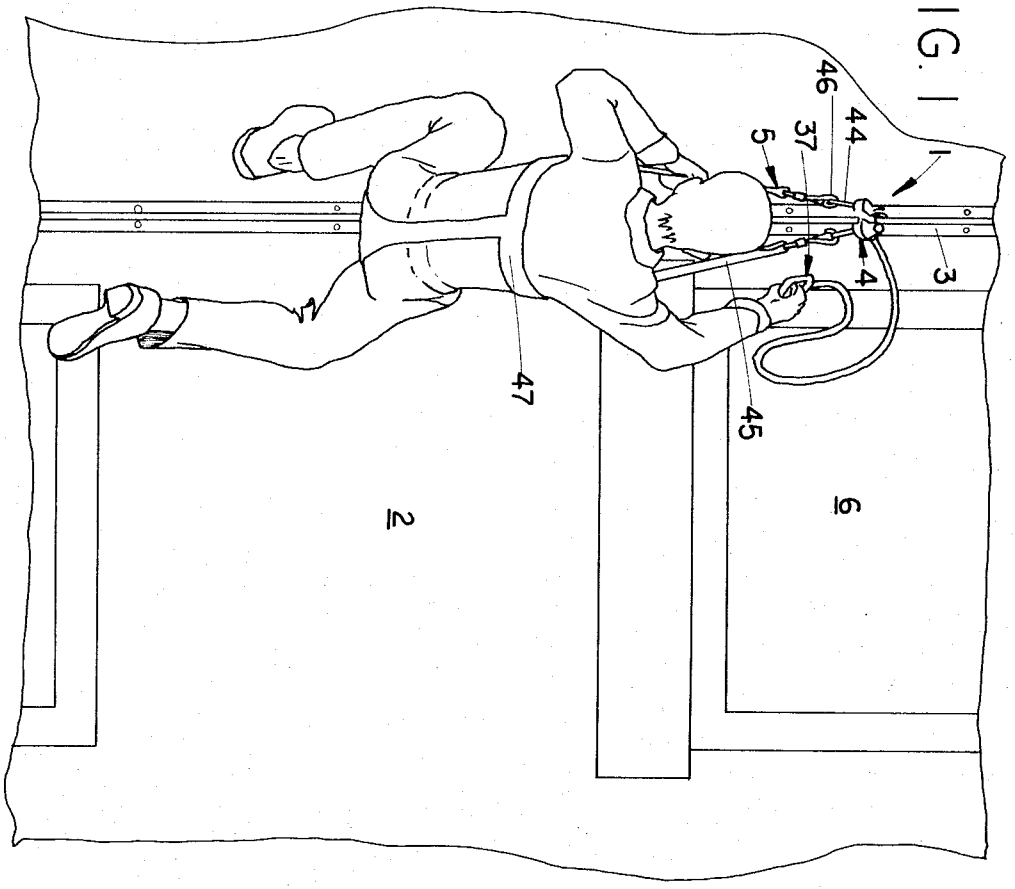
FIG. 1 is a fragmentary elevational view of an exterior building wall face illustrating a person descending along the building wall using the descent device of the present invention.

FIG. 1 shows an environmental view of the descent device, shown generally at 1, in use to enable a person to be lowered in a controlled manner along the exterior vertical building wall face, indicated generally at 2.

Descent device 1 is made up of three parts. A vertically extending rail-like support track 3 is fixedly secured to the exterior building wall face 2. Hand operable brake means 4 slidably cooperate with the track for descending therealong at a selectable rate. Means in the form of a harness 5 are attached to brake means 4 for supporting the user.

Figure 2:
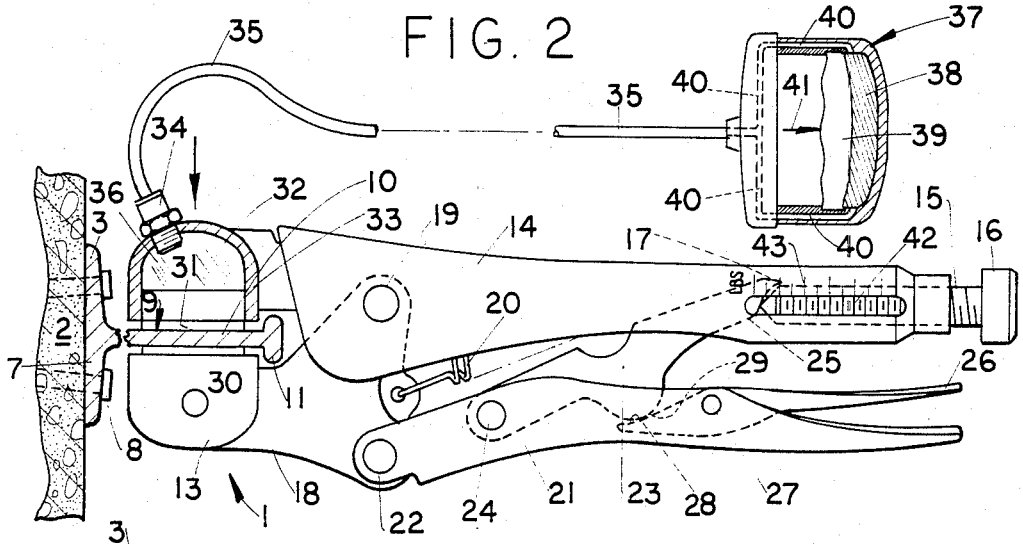
FIG. 2 is a fragmentary partially cross sectional plan view of the descent device of the present invention.
Figure 3:
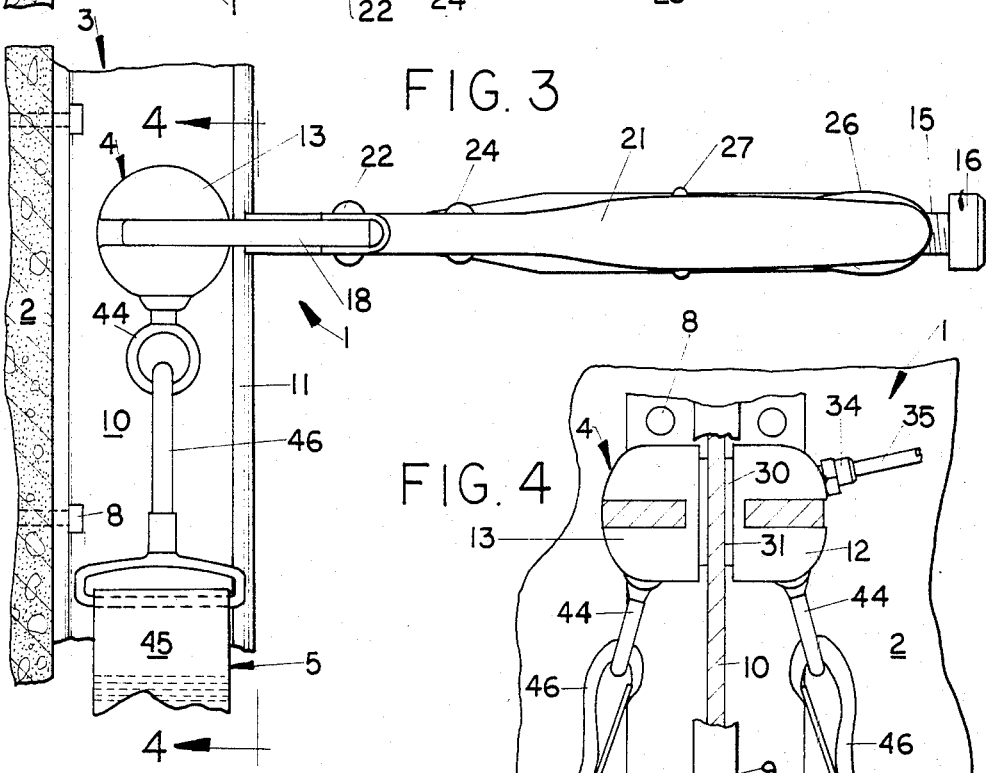
FIG. 3 is a fragmentary partially cross sectional elevational view of the descent device of the present invention.
Figure 4:
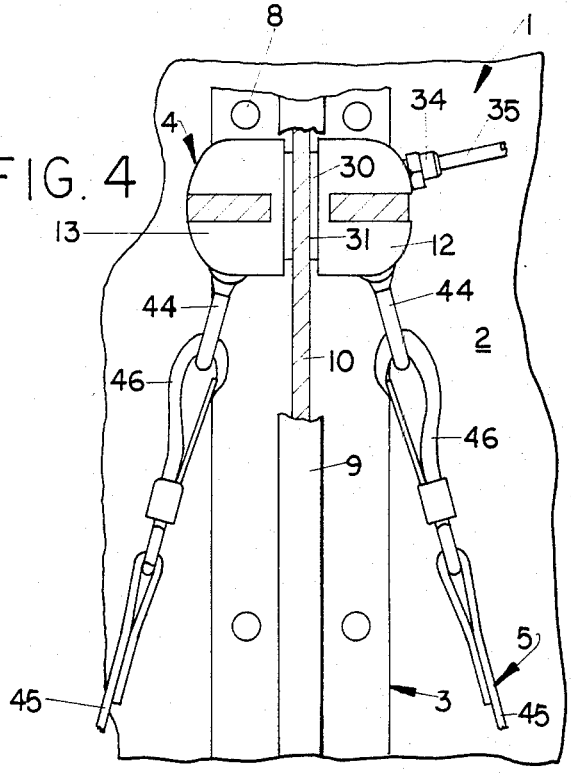
FIG. 4 is a fragmentary partially cross sectional view taken along section line 4—4 of FIG. 3.

Referring to FIG. 1 and FIG. 2, it is contemplated that track 3 will extend vertically along the entire exterior face of the building wall 2. In general, it is preferred that track 3 be located adjacent the building windows 6 so that the user may gain easy access thereto. Furthermore, it is also contemplated that the upper end of track 3 will extend to the roof of the building, so that brake means 4 can be hooked onto the track at that point also.

As shown in FIG. 2, track 3 comprises a strip-like foot portion 7 having a flat undersurface which is secured to the building wall by adhesive, screws, nails or the like 8.

An outwardly extending flange 9 extends outwardly from the medial portion of track foot 7 and runs the length thereof. Flange 9 includes an outwardly extending web portion 10 terminating at its outermost edge in a flange-like head 11. It will be observed that the construction of track 3 thus resembles a railroad rail, although substantially smaller.

Track 3 may be constructed of any suitable material having sufficient strength, preferably steel, anodized aluminum or the like. Furthermore, track 3 may be provided as part of a structure for enabling window washers or other maintenance personnel to traverse the side of the building. It is contemplated that track 3 will be provided as a permanent part of the building structure, installed when the building is erected.

Hand operable brake means 4 act as a clamp for slidingly engaging track 3 with a selectable clamping force.

In a preferred embodiment, the brake means includes a pair of opposed jaws 12 and 13 which can be brought to an opened position where the jaws are separated by a sufficient distance that they can be slipped over head 11 of track 3, and to a closed position wherein jaws 12 and 13 are clamped against the vertically extending surfaces of web portion 10 of the track as illustrated in FIG. 2. For purposes of explanation, jaw 12 will be referred to as the fixed jaw, while jaw 13 will be referred to as the movable jaw.

Fixed jaw 12 is fixedly attached to an outwardly directed elongated channel-like fixed handle 14 which has an outer surface adapted to be easily grasped by the hand. As shown in FIG. 2, fixed jaw 12 and handle 14 are connected so that handle 14 is substantially perpendicular to building wall face 2 when brake means 4 is slidingly attached to track 3. The outermost end of fixed handle 14 contains an internally threaded sleeve which threadedly accepts a threaded shank 15 terminating at its outer end in a knurled thumb screw 16. The inner end of threaded shank 15 terminates in a head or camming surface 17.

Movable jaw 13 is fixedly connected to a pivot member 18 which is pivotally secured to fixed handle 14 as at 19. A spring 20 has one end connected to the outermost end of pivot member 18 and the other end to handle 14 so as to urge the pivot member toward fixed handle 14.

An elongated manually graspable movable handle 21 is pivotally connected to pivot member 18 as at 22 so that movable handle 21 and fixed handle 14 extend generally parallel when brake means 4 is in the closed clamping position as illustrated in FIG. 2.

An elongated stud lever or fulcrum bar 23 is pivotally attached to movable handle 21 as at 24 at a point spaced outwardly from pivotal connection 22. The opposite end 25 of fulcrum bar 23 is positioned to lie in abutting engagement with camming surface 17 of threaded shank 15. Consequently, as illustrated in FIG. 2, as thumb screw 16 is rotated so as to move the threaded shank inwardly, fulcrum bar 23 is rotated in a counter-clockwise direction.

An elongated releasing lever 26 is pivotally connected at its innermost end to movable handle 21 as at 27 so that the releasing lever extends generally parallel to the outermost end of movable handle 21. The innermost end 28 of releasing lever 26 forms a surface configured to abut a camming surface 29 extending outwardly from the medial portion of fulcrum bar 23. With this construction, it will be observed that when the outermost end of releasing lever 26 is moved toward movable handle 21, the engagement of abutment surface 28 and camming surface 29 will cause fulcrum bar 23 to move in a counter-clockwise direction as illustrated in FIG. 2.

It will be understood that a portion of the operating mechanism just described is well understood in the art in connection with hand tools generally referred to as locking plier wrenches, such as those described in U.S. Pat. No. 2,280,005 issued Apr. 14, 1942 to W. Petersen and U.S. Pat. No. 2,514,130 issued July 4, 1950 to H. T. Jones, the disclosures of which is incorporated herein by reference, and generally sold under the trademark VISE GRIP® by the Petersen Manufacturing Co. of DeWitt, Nebr. Such a locking plier wrench has been used in the embodiment just described by modifying the jaws normally associated with such tool, and replacing them with the specific jaw and brake structure to be described hereinafter.

Specifically, in the present invention, the jaws of the conventional locking plier wrench have been replaced by jaws 12 and 13, one of which comprises a manually actuable brake mechanism. Although for purposes of an exemplary showing, only fixed jaw 12 will be described as incorporating the brake mechanism, it will be understood that either or both of the brake structures may incorporate the brake.

As illustrated in FIG. 2, jaw 12 incorporates a brake pad or shoe 30 having a generally planar inner surface 31 for frictionally engaging one of the side surfaces of web portion 10 of track 3.

As best shown in FIG. 2, fixed jaw 12 comprises a hemispherical enclosure 32 terminating at its inner end in a cylindrical cylinder portion 33. Brake shoe 30 comprises a cylindrical piston which is slidably received within cylinder 33. A fitting 34 extends through the wall of jaw 12 into hemispherical chamber 32 and is connected to a tube-like flexible hydraulic fluid supply line 35. The interior of hemispherical chamber 32 and cylinder 33, as well as supply line 35, are filled with a suitable hydraulic fluid 36.

The opposite end of supply line 35 is operably connected to hand operable actuator means shown generally at 37 for operating brake pad or shoe 30. In the embodiment illustrated, actuator 37 comprises a reservoir chamber 38 containing a supply of hydraulic fluid and a hand operated piston-like plunger 39. A pair of internal channels 40 connect reservoir 39 with hydraulic fluid supply line 35. It will be observed that actuator means 37 is dimensioned to be grasped by the human hand as illustrated in FIG. 1. Consequently, when plunger 39 is operated in the direction of arrow 41, hydraulic fluid within reservoir 38 will be forced out of the reservoir, through channels 40, and into supply line 35. This causes the fluid to fill hemispherical chamber 32 and push brake pad or shoe 30 outwardly. Consequently, by controlling the manual pressure applied to plunger 39, the hydraulic fluid pressure, and consequently the force exerted by engaging surface 31 of brake pad or shoe 30 against the sliding surface of web portion 10, can be controlled.

In the embodiment described, the brake pad or shoe 30 associated with movable jaw 13 is fixed in place so that operation of movable jaw 12 as just described tends to squeeze web portion 10 between the opposing brake pad or shoes. However, it will be understood that jaw 13 may be constructed in a manner similar to that previously described for jaw 12 so that both brake pad or shoes are hydraulically operated. Similarly, the brake pad or shoe 30 associated with fixed jaw 12 may be fixed in place, and the shoe associated with movable jaw 13 made hydraulically movable.

Alternately, it will be understood that other methods for manually actuating brake pad or shoe 30 may be substituted, such as a pneumatic actuator, or by direct mechanical connection between plunger 39 and brake pad or shoe 30. In any event, by squeezing plunger 39, the amount of force exerted against the cooperating abutting face of track 3 can be selectively controlled.

In many instances, it may be desirable to preset the force exerted by the jaws against the track. This can be accomplished by adjustment of thumb screw 16. As will be observed in FIG. 2, by rotating thumb screw 16 so that camming surface 17 is moved inwardly, fulcrum bar 23 is rotated counter-clockwise, thereby increasing the spacing between fixed handle 14 and movable handle 21, thereby also increasing the spacing between jaws 12 and 13. Consequently, when handles 14 and 21 are squeezed together, the action just described serves to decrease the clamping force of the jaws against track 3.

Conversely, when thumb screw 16 is rotated so as to withdraw threaded shank 15, i.e. to move camming surface 17 to the right as illustrated in FIG. 2, fulcrum bar 23 will be rotated clockwise, causing jaws 12 and 13 to be more closely spaced when handles 14 and 21 are squeezed together and locked in place. This causes a greater clamping force to be exerted by brake pad or shoes 30 against track 3.

As can be seen in FIG. 2, this adjustment means can be calibrated for particular weights to be supported by brake means 4. For example, a longitudinally extending elongated slot 42 may be provided in the outermost end of fixed handle 14 so that the contact point between camming surface 17 and abutment surface 25 can be observed. A graduated scale 43 having index markings corresponding to various weights to be supported by the descent device 1 may be provided along side of slot 42. These index markings may then be calibrated against desired clamping forces between jaws 12 and 13 to produce a particular rate of descent when actuator means 37 is not actuated. In other words, by bringing the contact point between camming surface 17 and abutment surface 25 to a particular index numeral corresponding to the user's weight, the user can be assured that the appropriate initial or preset claming force will be exerted against track 1 when brake means 4 is clamped onto the track.

Harness 5 comprises a hook eye 44 secured to the bottom of each of jaws 12 and 13. A pair of harness straps 45 are provided at their uppermost ends with snap fasteners 46 for engaging hook eyes 44. Harness straps 45 are in turn attached to a suitable harness structure 47 such as that illustrated in FIG. 1 for supporting the user.

In operation, release lever is pivoted toward movable handle 21 so as to rotate fulcrum bar 23 counter-clockwise as illustrated in FIG. 2, thus causing fixed handle 14 and movable handle 21 to separate. Thumb screw 16 may then be operated to set brake means 4 to the appropriate initial clamping force by reference to graduated weight scale 43 as previously described.

With jaws 12 and 13 separated, brake means 4 is then slipped over track 3, and handles 14 and 21 squeezed together, thereby clamping brake pad or shoe surfaces 31 against the cooperating surfaces of web 10.

It will be observed that handles 14 ad 21 are operable to move the jaws to a closed clamping position when the handles are squeezed together wherein the jaws are in abutting contact with track 3, and to move the jaws to an opened position when the handles are moved apart wherein the jaws are moved out of abutting contact with the track. Brake means 4 also includes locking means which are actuated by squeezing the handles together to retain the jaws in the closed position. In the embodiment illustrated, these locking means comprise lever member of fulcrum bar 23 which is pivotally attached to handle 21 and extends toward handle 14. As noted hereinabove, handle 14 includes threaded shank 15 which has head portion 17 adapted to abut the contact end 25 of fulcrum bar 23. Contact end 25 is brought into firm engagement with the shank head to place the fulcrum bar in compression when the handles are squeezed together. These compression forces are transmitted through the handles to the jaws to restrain the jaws in the closed clamping position. As noted, the effective length of threaded shank 15 can be varied to change the travel distance of lever member of fulcrum bar 23, and thereby adjust the spacing between the jaws when the jaws are in the closed clamping position.

It will be observed that when brake means 4 is clamped against the track, that the spacing between jaws 12 and 13, illustrated as d in FIG. 2 is less than the width of head 11. This prevents the clamped brake means from being pulled off of the front edge of the track. Harness structure 47 may then be secured to the user, and snap fasteners 46 attached to hook eyes 44.

With plunger 39 of actuator means 37 fully depressed, thereby actuating brake pad or shoe 30, the user may then swing outwardly so as to hang suspended beneath brake means 4. By gradually releasing plunger 39, brake pad or shoe 30 will release slightly, thereby decreasing the clamping force exerted on track 3 permitting brake means to slide downwardly along the track, maintaining a orientation generally perpendicular to the building wall 2. To increase the descent speed, the force exerted by brake pad or shoe 30 can be decreased by further releasing plunger 39. To slow the rate of descent, plunger 39 may be squeezed more tightly thereby increasing the clamping force against the track.

When the user has reached the lower end of the track, or any intermediate point of egress, brake means 4 can be disengaged from the track by merely releasing lever 26 as previously described.

Figure 5:
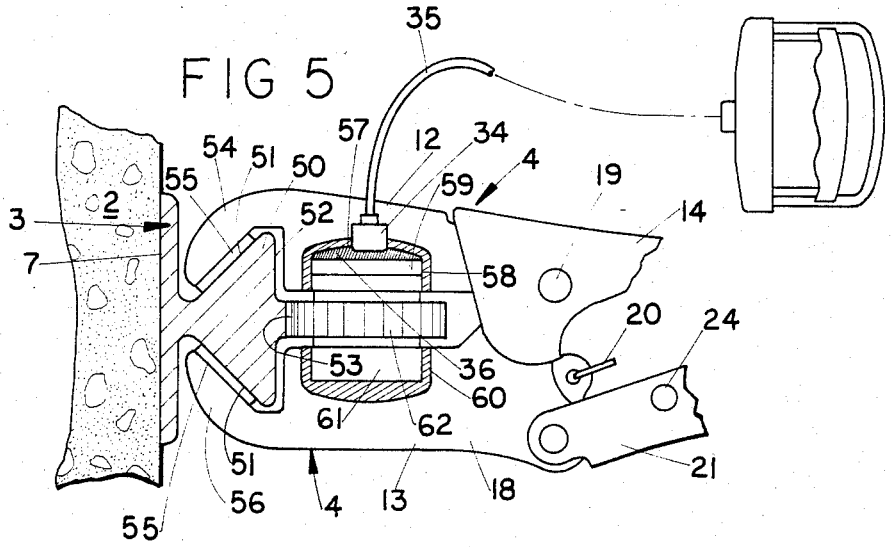
FIG. 5 is a fragmentary partially cross sectional plan view of a second embodiment of the descent device of the present invention.

A second embodiment of the descent device 1 of the present invention is illustrated in FIG. 5, where elements similar to those previously described have been similarly designated. This embodiment provides more positive locking of the descent device against track 3 so as to prevent its disengagement therefrom.

In this embodiment, track 3 is generally triangular-shaped in cross section, and includes a foot portion 7 attached to building wall 2 as previously described, and an outwardly extending rail portion 50 of triangular cross section. Rail 50 includes a pair of inclined generally planar side surfaces 51, and an outermost face 52 extending generally parallel with foot portion 7. The outermost face of rail 50 is provided with a centrally positioned vertically extending continuous rack 53 having a plurality of spaced parallel horizontally extending teeth in the nature of such rack structures.

In this embodiment, the jaw structure of brake means 4 has been modified from the embodiment previously described, the remaining structure of the brake means being the same.

In the modified jaw structure, the innermost end of fixed jaw 12 terminates in a downwardly inclined hook-like lip portion 54. The inner face of upper lip portion 54 is provided with a sliding surface plate 55 configured to slidingly abut the upper inclined side surface 51 of rail 50.

Similarly, the forwardmost portion of pivot member 18 is provided with an upwardly inclined hook-like lip portion 54, also provided with a lower sliding surface 55 for slidingly abutting the lower inclined surface 51 of rail 50. As illustrated in FIG. 5, lip portions 51 and 54 and their associated sliding surfaces cooperate to prevent brake means 4 from becoming disengaged from rail 50.

Fixed jaw 12 mounts a hemispherical chamber 57 terminating at its innermost end in a generally cylindrical cylinder portion 58. A cylindrical piston 59 is permitted to reciprocate but not rotate within cylinder 58. Hemispherical chamber is filled with a suitable hydraulic fluid 36. A fitting 34 and hydraulic fluid supply line 35 connect brake means 4 with actuator means 37 as previously described.

Movable handle 21 is provided with a transversely extending circular bore 60. The inner portion of cylinder 58 and bore 60 rotatably mount a cylindrical shaft 61, upon which is centrally mounted a spur gear 62. As illustrated in FIG. 5, gear 62 is positioned so that its teeth mesh with the teeth on rack 53 when brake means 4 is clamped on track 3.

It will be observed that rack 53 and spur gear 63 form a rack and pinion arrangement wherein gear 62 is free to rotate as brake means 4 moves along track 3. However, when plunger 39 of actuator means 37 is actuated so that hydraulic fluid is forced into chamber 57, piston 59 is forced against the end of shaft 61, thereby preventing the rotation of shaft 61.

In operation of the embodiment of FIG. 5, the handles of the brake means are separated as previously described, and the jaw portions clamped over rail 50. It will be observed that when the brake means is clamped against the rail, sliding surfaces 55 tend to bear against the rearmost surfaces of the rail, while spur gear 62 is held firmly in engagement with rack 53. This provides positive engagement of the brake means with the track, and insures that the brake means will not be pulled off of the track. To slow the rate of descent, plunger 39 is activated, thereby urging piston 59 against the end face of shaft 61. The frictional engagement between the piston and the end of the shaft restricts rotation of the shaft, thereby enabling descent along the track at a controlled rate.

It will be observed that the descent device just described provides a useful way to control the speed of descent along the exterior face of a building. The rate of descent is at all times under control of the user by means of a hand-held actuator control. The descent device can be stopped at any place along the track. When the device is used in winter weather, the descent device will brake the ice adhering to the track as it moves downwardly. As noted, the descent device of the present invention finds particular utility as an emergency escape device which can be easily operated by an inexperienced person.

It will be understood that various changes can be made in the steps, details, materials and arrangements of parts, within the principle and scope of the present invention as expressed in the appended claims. For example, the track illustrated in connection with the embodiment of FIG. 2 may be modified to include the rack and pinion gear arrangement described in FIG. 5. Alternately, the rail design of triangular cross section utilized in FIG. 5 may be substituted for the I-shaped rail utilized in FIG. 2. Other means for actuating the brake pad or shoes such as a direct mechanical linkage, air pressure or the like may also be substituted all within the principle of the present invention. Finally, a locking plier wrench construction of the type commonly sold by Sears Roebuck & Co. may be modified in a manner simlar to the VISE GRIP® wrench modification described to form the brake means of the present invention.

The embodiments of the invention in which an exclusive property or privilege is claimed are as follows:

1. Apparatus for descending in a controlled fashion along an exterior building wall face comprising a vertically extending rail-like support track fixedly secured to the exterior building wall face, hand operable brake means slidingly cooperating with said track for descending therealong at a selectable rate, and means attached to said brake means for supporting the user, said brake means including manually operable clamp means for slidingly engaging said track and means for varying the clamp force between said clamp means and said track for controlling the rate of descent along said track.

2. The apparatus according to claim 1 wherein said track includes an outwardly extending flange running the length thereof.

3. The apparatus according to claim 2 wherein said flange comprises an outwardly extending web portion terminating at its outermost edge in a vertically extending flange-like head.

4. The apparatus according to claim 2 wherein said flange comprises a rail of generally triangular cross section.

5. The apparatus according to claim 4 wherein the outermost face of said flange is provided with a continuous rack and said brake means includes spur gear means cooperating with said rack to control the rate of descent.

6. The apparatus according to claim 1 wherein said clamp force varying means comprises hand operable actuator means for selectively varying the clamp force exerted against the track.

7. The apparatus according to claim 6 wherein said clamp force varying means further includes means for presetting a fixed clamp force against the track.

8. The apparatus according to claim 1 wherein said clamp means includes first and second opposing jaws for clamping said track therebetween, said clamp force varying means comprising means for varying the spacing between said jaws.

9. The apparatus according to claim 8 including first and second elongated manually graspable handles attached to said first and second jaws, respectively, said handles being operable to move said jaws to a closed clamping position when the handles are squeezed together wherein said jaws are in abutting contact with said track and to move said jaws to an opened position when said handles are moved apart wherein said jaws are moved out of abutting contact with the track, and locking means actuated by squeezing said handles together for retaining said jaws in said closed position.

10. The apparatus according to claim 9 wherein said clamp force means comprises a brake pad or shoe associated with at least one of said jaws and hand operable means for selectively moving said shoe toward the opposite jaw to increase the force exerted against the track and thereby slow the rate of descent.

11. The apparatus according to claim 10 wherein said hand operated means comprises a reservoir of hydraulic fluid, a manually operable actuator for controlling the pressure of said fluid, said clamp force means including a cylinder, a piston reciprocable within said cylinder, and means operably connecting said piston to said brake pad or shoe, and a flexible fluid supply conduit connecting said reservoir to said cylinder.

12. The apparatus according to claim 10 including a flexible control line connecting said clamp force means and said hand operable means.

13. The apparatus according to claim 9 wherein said locking means comprises a lever member pivotally attached to one of said handles and including a contact end extending toward the other of said handles, and last mentioned handle including a shank having a head portion adapted to abut said contact end, said contact end being brought into firm engagement with said shank head to place said lever member in compression when said handles are squeezed together, said compression forces being transmitted through said handles to said jaws to restrain said jaws in the closed clamping position.

14. The apparatus according to claim 13 including means for adjusting the spacing between said jaws when said jaws are in the closed clamping position, said adjusting means comprising means for adjusting the length of said shank to vary the travel distance of said lever member.

15. The apparatus according to claim 14 including unlocking means and associated with said locking means for separating said handles to permit moving said jaws to said opened position.

16. The apparatus according to claim 15 wherein said unlocking means comprises a releasing lever pivotally attached to said lever member, the end of said releasing lever adjacent said pivotal attachment comprising a contact point, the opposite end of said releasing lever forming a handle, said contact point being operable to abut said operating handle when said releasing lever handle is moved away from said operating handle when said jaws are in the closed clamping position to move said lever member out of contact with said shank head thereby causing said handles to separate to release said locking means.

17. The apparatus according to claim 1 wherein said brake means includes means for presetting a fixed frictional sliding force agains the track as a function of the user's weight.

18. The apparatus according to claim 17 wherein said clamp means includes first and second opposing jaws for clamping said track therebetween, first and second elongated manually graspable handles attached to said first and second jaws, respectively, said handles being operable to move said jaws to a closed clamping position when the handles are squeezed together wherein said jaws are in abutting contact with said track and to move said jaws to an opened position wherein said handles are moved apart wherein said jaws are moved out of abutting contact with the track, and locking means actuated by squeezing said handles together for retaining said jaws in said closed position, said locking means comprising a lever member pivotally attached to one of said handles and including a contact end extending toward the other of said handles, said other handle including a shank having a head portion adapated to abut said contact end, said contact end being brought into firm engagement with said shank end to place said lever member in compression when said handles are squeezed together, said compression forces being transmitted through the handles to the jaws to restrain the jaws in closed clamping position, said presetting means comprising means for adjusting the spacing between said jaws when the jaws are in the closed clamping position and including means for adjusting the length of said shank to vary the travel distance of said lever member.

19. The apparatus according to claim 18 including unlocking means in association with said locking means for separating said handles to permit moving said jaws to said opened position, said unlocking means comprising a releasing lever pivotally attached to said lever member, the end of said releasing lever adjacent said pivotal attachment comprising a contact point, the opposite end of said releasing lever forming a handle, said contact point being operable to abut said operating handle when said releasing lever handle is moved away from said operating handle when the jaws are in the closed clamping position to move said lever member out of contact with said shank end thereby causing said first and second handles to separate to release said locking means.

20. The apparatus according to claim 1 including a continuous rack having a plurality of teeth associated with said track, said brake means including a spur gear rotatably supported by said brake means such that said gear and said rack mesh when said brake means is clamped to the track, a hand operated actuator and means responsive to said actuator for limiting rotation of the gear to control the speed of descent of said brake means along the track.

21. The apparatus according to claim 20 wherein said track is of generally triangular cross section, the outermost face of said track mounting said rack, said clamp means including a pair of opposing jaws, said jaws slidingly cooperating with the rearmost faces of said track.

22. The apparatus according to claim 21 including a reservoir of hydraulic fluid, said actuator controlling the pressure of said fluid, said brake means including a cylinder, a piston reciprocable within said cylinder, and means operatively connecting said piston to said gear, and a flexible fluid supply conduit connecting said reservoir to said cylinder, said piston being hydraulically operable by said actuator to restrain rotation of said gear.

23. The apparatus according to claim 2 including a continuous rack having a plurality of teeth mounted on the outermost face of said flange, said clamp means comprising first and second opposing jaws for slidably engaging the rearmost faces, respectively, of said flange for clamping said track therebetween, first and second elongated manually graspable handles attached to said first and second jaws, respectively, said handles being operable to move said jaws to a closed clamping position when the handles are squeezed together wherein said jaws are in abutting sliding contact with said track and to move said jaws to an open position wherein said handles are moved apart when said jaws are moved out of abutting contact with the tract, locking means actuated by squeezing said handles together for retaining said jaws in said closed position, a spur gear rotatably mounted between said jaws such that said gear and said rack mesh when said brake means is clamped to the track, a hand operated actuator and means responsive to said actuator for limiting rotation of the gear to control the speed of descent of said brake means along the track.

24. The apparatus according to claim 23 wherein said limiting means comprises a reservoir of hydraulic fluid, said actuator controlling the pressure of said fluid, brake means including a cylinder, a piston reciprocable within said cylinder, and means operably connecting said piston to said gear for controlling the rotation thereof, and a flexible fluid supply conduit connecting said reservoir to said cylinder.

25. The apparatus according to claim 24 wherein said locking means comprises a lever member pivotally attached to one of said handles and including a contact end extending toward the other of said handles, said last mentioned handle having a shank with a head portion adapted to abut said contact end, said contact end being brought into firm engagement with said shank head to place said lever member in compression when said handles are squeezed together, said compression forces being transmitted through said handles to said jaws to restrain said jaws in the closed clamped position.

26. The apparatus according to claim 25 including adjusting means comprising means for adjusting the length of said shank to vary the travel distance of said lever member.

27. The apparatus according to claim 26 including unlocking means in association with said locking means for separating said handles to permit moving said jaws to said opened position, said unlocking means comprising a releasing lever pivotally attached to said lever member, the end of said releasing lever adjacent said pivot attachment comprising a contact point, the opposite end of said releasing lever forming a handle, said contact point being operable to abut said operating handle when said releasing lever handle is moved away from said operating handle when said jaws are in the closed clamping position to move said lever member out of contact with said shank head to cause said first and second handles to separate to release said locking means.

28. The apparatus according to claim 1 including means associated with said brake means for positively preventing disengagement of the brake means from the track.

29. The apparatus according to claim 3 wherein said clamp means including first and second opposing jaws for clamping said track therebetween, the spacing between said jaws when clamped against the track being less than the width of said flange-like head to prevent the brake means from becoming disengaged from the track.

30. The apparatus according to claim 4 wherein said clamp means comprising first and second opposing jaws for clamping said track therebetween, each of said jaws terminating in a hook-like lip adapted to slidingly engage an associated surface of said rail, and means associated with said brake means for positively engaging the front surface of said rail, said lips and said engaging means cooperating to prevent disengagement of the brake means from the track.

* * * * *